United States Patent [19]

Schiller

[11] Patent Number: 4,633,545

[45] Date of Patent: Jan. 6, 1987

[54] AUTOMOBILE DOOR HINGE CONSTRUCTION

[76] Inventor: Darrell Schiller, 407½W. Avenue G, Temple, Tex. 76501

[21] Appl. No.: 575,508

[22] Filed: Jan. 31, 1984

[51] Int. Cl.[4] ..... E05D 11/04

[52] U.S. Cl. ..... 16/275; 16/273

[58] Field of Search ..... 16/275, 273, 346, 388, 16/334, 234, 260–263, 276, 371, 221

[56] References Cited

U.S. PATENT DOCUMENTS

| | | | |
|---|---|---|---|
| 1,245,733 | 11/1917 | Katzenberger | 16/276 |
| 3,001,224 | 9/1961 | Soss | 16/276 |
| 3,241,177 | 3/1966 | Andersen | 16/275 |
| 3,662,493 | 5/1972 | Foltz | 16/275 |
| 4,097,959 | 7/1978 | Johnson | 16/276 |

FOREIGN PATENT DOCUMENTS

| | | | |
|---|---|---|---|
| 2047327 | 11/1980 | United Kingdom | 16/273 |

*Primary Examiner*—E. R. Kazenske
*Assistant Examiner*—James L. Welfe
*Attorney, Agent, or Firm*—Paul H. Gallagher

[57] ABSTRACT

In an automobile door hinge which includes a leaf mounted on the body and a leaf mounted on the door, the leaves having parallel overlapping flanges, with a hinge pin in aligned holes in the flanges, hinge plates are secured to the flanges of the body leaf with sealed ball bearings receiving the hinge pin.

3 Claims, 3 Drawing Figures

AUTOMOBILE DOOR HINGE CONSTRUCTION

BACKGROUND OF THE INVENTION

Automobile door hinges are ordinarily made of a pair of metal stampings each having struck-over flanges, with the flanges of both stampings overlapped, and a hinge pin fitted in aligned holes in the four overlapped flanges. There is normally much friction between the respective moving parts, and corresponding wear, resulting in misaligned elements, and doors that sag or otherwise fail to match with or fit with the door frame elements.

OBJECTS OF THE INVENTION

A broad object of the invention is to provide a hinge construction for an automobile door having the following features and advantages:

1. It includes a novel ball bearing construction effective for virtually eliminating wear and consequently retaining the door in the true and non-sagging condition.

2. It can be incorporated in presently known hinge construction without requiring special design of the hinge for the purpose.

3. It can be easily added to and effectively incorporated in a hinge already in use.

DESCRIPTION OF A PREFERRED EMBODIMENT

The hinge construction of the present invention is particularly adaptable to hinges already in use, although it is equally adaptable to incorporation in a new hinge in the original construction thereof.

Figure 1:
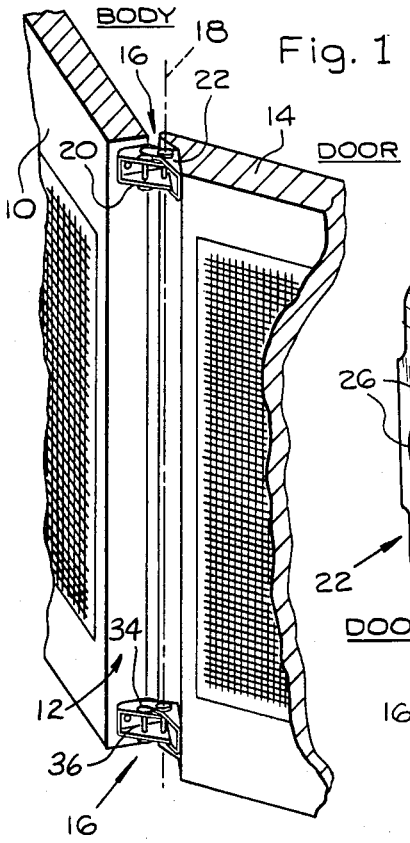
FIG. 1 is a fragmentary perspective view of a portion of an automobile body and door showing the hinges by which the door is mounted.

Referring in detail to the drawings, FIG. 1 shows a fragment of an automobile body 10 forming a door frame 12 and a fragment of the door itself, 14. This figure shows a pair of hinges 16 mounting the door on the door frame, in vertically spaced position in an ordinary manner. The hinges, as is known, include hinge pins which are aligned on an axis 18 that is vertical, or near vertical. The hinges 16 may be identical, or at least their construction is such that the features of the present invention are identical in the two hinges, and a description of one will suffice for both.

Figure 2:
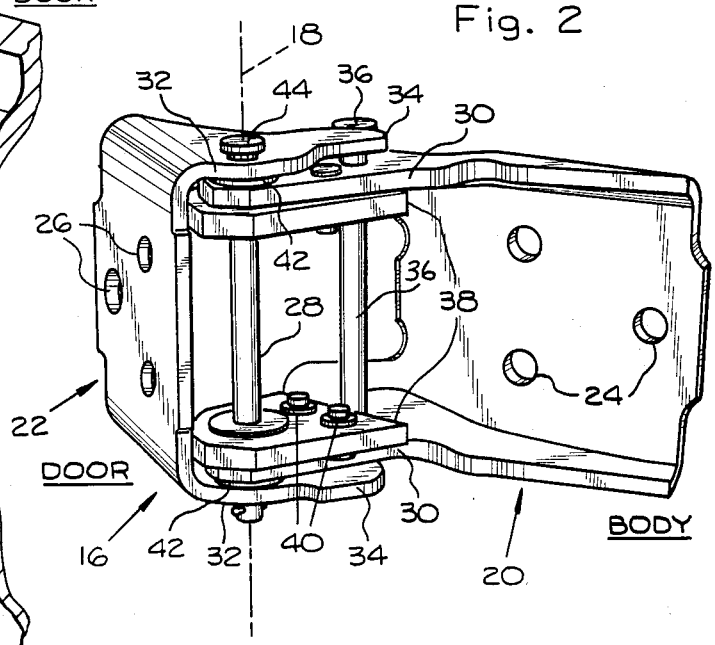
FIG. 2 is a perspective view of a hinge isolated from the automobile, embodying the features of the invention.
Figure 3:
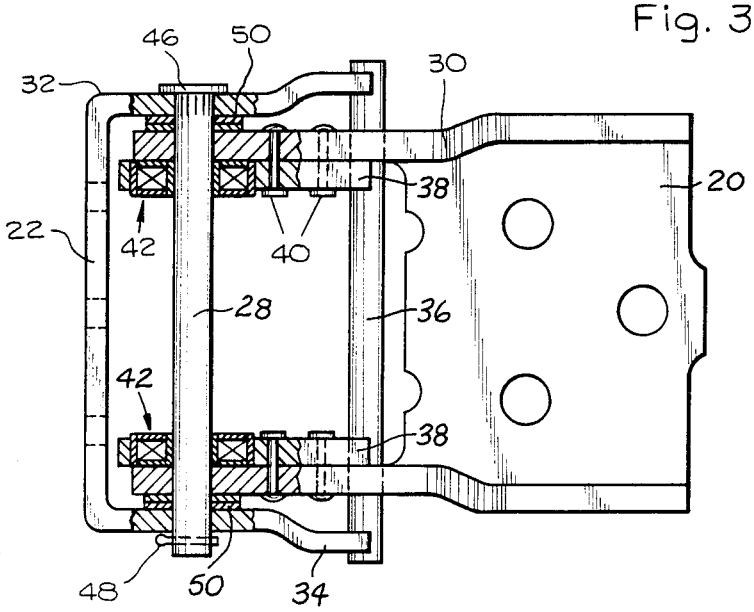
FIG. 3 is a face view, oriented nearly in the direction of FIG. 2 and showing a portion in section.

FIGS. 2 and 3 show a hinge 16 in detail, which includes a body leaf 20, or body mount hinge side, secured to the door frame 12, and a companion door leaf 22, or door mount hinge side, mounted on the door 14. The hinge itself includes a basic structure that is of known kind, and the leaves 20, 22 are mounted on the body and door respectively in a known manner, the leaves having holes 24, 26 for that purpose.

The hinge includes a hinge pin 28 pivotally or swingably mounting the leaves together, in a specific manner referred to hereinbelow.

The body leaf 20 includes parallel side flanges or ears 30 at the outer end adjacent to or beyond the outer side of the automobile body. Similarly the door leaf 22 includes parallel side flanges or ears 32 merging into and forming lugs 34. The flanges 30, 32 are in overlapping relation and provided with aligned holes which receive the hinge pin 28 for swinging movement of the door about the axis 18 referred to above.

The construction described above is of generally known type and incorporated in hinge constructions heretofore known. In such constructions, the door hinge leaves were supported directly by the flanges, and in the relative turning or swinging movement of the hinges, there was friction rubbing engagement between the marginal surfaces of the holes and the pin, as well as between elements of the hinge leaves themselves, with consequent serious abrasive and wearing effect.

A stop pin 36 is provided, mounted in the flanges 30 of the body leaf, engageable by the arms 34 to limit the opening swinging movement of the door relative to the automobile body. This stop pin also was included in hinge constructions heretofore known.

Because of the serious abrasive effect referred to, the holes in which the hinge pin 28 is fitted became gouged out and enlarged, and the pins worn and reduced in size, with consequent less accurate mounting of the door, and the door often sagged because of that, adversely affecting its closing and opening movements and the latching or locking thereof.

The construction of the present invention is effective for overcoming that serious drawback. The novel feature includes a pair of hinge plates 38, similar in size and shape to the flanges 30, and fitted to the flanges on the inner sides of the latter, and secured thereto by suitable means, in the present instance by means of rivets 40 extending through the hinge plates and flanges. These rivets are spaced apart and they thereby hold the hinge plates solidly and firmly against the flanges throughout the mutual contact area thereof. An effectively, integral bonding between the two is produced. These plates may be secured in other ways also, such as by welding.

Each hinge plate is provided with a bearing unit 42 which is preferably a sealed ball bearing. In mounting these bearing units, the hinge plates 38 are provided with suitable holes therethrough to receive the bearing units in a tight fit, holding them in place against any forces tending to dislodge them. The hinge pin 28 is then fitted through the bearing units and the holes theretofore existing in the flanges. The hinge pin is preferably provided with a head 44 at one end, and next adjacent to the head, the body of the pin is provided with knurling 46 and the pin is driven in a tight fit in the hole in the flange 32 and thereby held against a rotation relative to that flange and thereby relative to the door hinge leaf 22 and consequently as the door is swung, the pin turns and the relative movement takes place within the bearing unit 42, i.e., the outer race of the bearing unit is frictionally held in the hinge plate while the inner race moves with the pin, that race being friction fitted on the pin. The opposite end of the pin may be held simply by a cotter key 48.

In keeping with the simplicity of the construction, the rivets 40 may have heads at both ends, and attention is directed to the outer ends of the rivets, where the heads engage the outer surfaces of the flanges 30, and in order to keep the flanges 32 on the door hinge leaf free of the rivet heads, spacer washers 50 are positioned between the respective flanges on the hinge leaves. It will be noted that the flanges 32 on the door hinge leaf are disposed outwardly of the flanges on the body hinge leaf, this arrangement being incorporated in the hinge in the original construction and in further keeping with the simplicity of the construction, the hinge plates 38 are disposed inwardly of the flanges 30. In the assembly of the hinge the flanges are of course all parallel.

The construction adapts itself very well to hinge constructions that are already in use, and it is also adaptable to incorporation in hinges in the original construction thereof.

The ball bearing units 42 are spaced adjacent to the ends of the hinge pin and thus are effective for retaining the door in proper upright position and this effect distributed in two hinges in the door has greater effect in that direction. The construction is extremely simple both in materials used and in the fabrication steps required, resulting in an inexpensive device.

I claim:

1. Automobile door hinge construction, for use in an automobile having a body and a door, in which the door is supported entirely by hinges on upright edges of the body and door and in which the door swings on an upright axis, comprising, a pair of leaves including a body leaf, and a door leaf, each leaf having a pair of parallel spaced apart side flanges and the two leaves are interfitted with their flanges overlapping, and the flanges of the two leaves at each side being closely adjacent, a hinge plate fitted flat against each of the flanges of one of the leaves and secured rigidly thereto, the overlapping flanges of the two leaves and the hinge plates having holes aligned on an axis coinciding with said upright axis when the hinge is mounted on the automobile, and the hinge including a hinge pin in said holes pivotally mounting the leaves together for mutual swinging movement, and sealed ball bearing means mounted in each of the hinge plates and on the hinge pin, and the ball bearing means being thereby in correspondingly spaced apart position, the hinge construction providing interconnecting support solely through the respective leaves which are spaced axially of the hinge pin, and the hinge plates in which the ball bearing means are mounted, the leaves and hinge plates providing their said support through the ball bearing means.

2. Construction according to claim 1 wherein, the leaves are so interfitted that the flanges of one of the leaves are positioned axially inwardly of the flanges of the other leaf, and the hinge plates are mounted on the axially inner surfaces of the flanges of said one of the leaves.

3. Construction according to claim 2 wherein, the leaves include a body leaf mounted on the automobile body in stationary position and a door leaf mounted on the door and swingable relative to the body leaf, the flanges of the body leaf are disposed axially inwardly of the flanges of the door leaf, the hinge pin is fixed against rotation in the body leaf, and the ball bearing units include inner and outer races, the inner race is fixed on the hinge pin against rotation and the outer race is fixed on the hinge plate in the door leaf for rotation with the door leaf.

* * * * *